US005607071A

United States Patent [19]

Kröll et al.

[11] Patent Number: 5,607,071

[45] Date of Patent: Mar. 4, 1997

[54] CRANE, ESPECIALLY A TRACK-BOUND MOBILE CRANE

[75] Inventors: Joachim Kröll, Jüchen; Peter Richter, Bergheim, both of Germany

[73] Assignee: Mannesmann Aktiengesellschaft, Düsseldorf, Germany

[21] Appl. No.: 381,194

[22] Filed: Jan. 31, 1995

[30] Foreign Application Priority Data

Jan. 31, 1994 [DE] Germany ..... 44 03 287.0

[51] Int. Cl.[6] ..... B66C 23/04

[52] U.S. Cl. ..... 212/231; 104/2; 212/224; 212/226; 212/238

[58] Field of Search ..... 212/224, 226, 212/230, 231, 238, 245, 247, 248, 261, 308, 258, 181, 306; 414/598, 687; 104/2, 3

[56] References Cited

U.S. PATENT DOCUMENTS

| | | | |
|---|---|---|---|
| 2,167,026 | 7/1939 | Hatch | 212/306 |
| 2,192,033 | 2/1940 | Dalton | 212/230 |
| 2,425,663 | 8/1947 | Wooldridge | 212/258 |
| 2,461,877 | 2/1949 | Brereton | 212/247 |
| 2,538,711 | 1/1951 | Tapper | 414/598 |
| 2,790,568 | 4/1957 | Mandt | 414/687 |
| 2,828,867 | 4/1958 | Frisk | 212/248 |
| 2,949,201 | 8/1960 | MacAlpine et al. | 212/231 |
| 3,042,234 | 7/1962 | Davis | 212/231 |
| 3,139,198 | 6/1964 | Penney et al. | 212/181 |
| 4,361,104 | 11/1982 | Lloyd et al. | 212/308 |
| 4,799,850 | 1/1989 | Petitto et al. | 414/687 |

FOREIGN PATENT DOCUMENTS

| | | | |
|---|---|---|---|
| 392672 | 10/1990 | European Pat. Off. | 212/181 |
| 919844 | 12/1956 | Germany . | |
| 2125241 | 11/1972 | Germany . | |
| 2119030 | 11/1972 | Germany . | |
| 2507476 | 8/1976 | Germany . | |
| 2633545 | 11/1977 | Germany . | |
| 2821286 | 11/1978 | Germany . | |
| 3102166 | 8/1982 | Germany . | |
| 3401311 | 8/1985 | Germany . | |
| 231828 | 7/1944 | Switzerland . | |
| 350781 | 1/1961 | Switzerland | 212/231 |

*Primary Examiner*—Thomas J. Brahan
*Attorney, Agent, or Firm*—Cohen, Pontani, Lieberman, Pavane

[57] ABSTRACT

A crane, particularly a track-bound mobile crane, having a luffing jib located on a vehicle frame so as to be slewable upward and downward around a horizontal axis and rotatable around a vertical axis. In order to transport long and heavy loads in narrow areas, especially during the construction of bridges or tracks, the luffing jib is supported on at least one swivel bearing located on a vehicle frame end and is slewable upward and downward or liftable by a lifting drive arranged between the ends of the vehicle frame.

14 Claims, 7 Drawing Sheets

CRANE, ESPECIALLY A TRACK-BOUND MOBILE CRANE

BACKGROUND OF THE INVENTION

1. Field of the Invention

The invention relates to a crane, particularly a track-bound mobile crane, such as, for example, a railway crane, with a luffing jib, which is attached to the frame of a vehicle so as to be slewable upward and downward around a horizontal axis and rotatable around a vertical axis.

2. Discussion of the Prior Art

Cranes of this type are known in large numbers (DE-OS 28 21 286). However, the known cranes are not suitable in a narrow area for a long extension and a high hoisting capacity. In railroad construction and bridge construction, use has been made until now of two separate traveling cranes and a cross piece suspended between them.

SUMMARY OF THE INVENTION

Accordingly, it is an object of the present invention to provide a crane with a large jib length and a high hoisting capacity in a narrow area while enjoying a large reach and of also allowing lateral lifting at permissible supporting forces, e.g., on wheels. The lateral area in this case is to be formed by a safety interval to a neighboring track or to an adjacent roadway.

According to the invention, this object is attained in the crane described above by virtue of the fact that the luffing jib, supported on at least one swivel bearing arranged on either end of the vehicle frame, can be moved upward or downward or lifted by means of a lifting drive located between the ends of the vehicle frame. The advantages of this construction are the upward and downward slewability of the luffing jib toward one side or the other, as well as a slewability of the telescopic luffing jib, so that upward slewing is possible to the left and to the right in respect to the side view of the crane, as are, furthermore, centrally parallel lifting, lateral slewing and lateral lifting.

Here it is advantageous that each of the swivel bearings can be individually detached from or connected to the luffing jib. Depending on the established connection, the swivel bearing in question forms the slewing axis on the horizontal and/or the vertical plane.

According to another embodiment, each of the swivel bearings consist of a piston-cylinder unit, which is arranged on one end of the vehicle frame and which can be connected in a hinged fashion to the luffing jib. Advantageously, the swivel bearing itself can thus be lifted.

In a further embodiment of the invention, the swivel bearings themselves are rotatable around a vertical axis on the vehicle frame. If the aforementioned connection exists, the luffing jib can therefore be slewed or rotated around this vertical axis.

An especially advantageous design for this turnability is achieved in that each of the piston-cylinder units is formed by telescopic tube sections with a lifting piston which engages under the cover of the inner tube section. In this way, a connection possibility for the luffing jib is created and, secondly, the aforementioned turnability as well as a space-saving arrangement of the lifting piston is achieved.

According to a further embodiment, the connection between the swivel bearing and the luffing jib is advantageously established in that each of the swivel bearings is arranged at a side frame part which is connected to the luffing jib and which can be slewed relative to the piston-cylinder unit around detachable hinge bolts. Detaching or connecting the luffing jib to the swivel bearing is there/ore carried out simply by detaching or inserting the hinge bolts, which can be done manually.

In yet a further embodiment of the invention, the lifting drive is arranged in a supported fashion on a slewing mechanism via a guide plate of the vehicle frame. Essentially, this permits horizontal slewing of the luffing jib.

According to another feature, a horizontal slewing drive is provided for the luffing jib attached to the lifting drive.

According to another embodiment preferred features, the horizontal slewing drive consists of a pinion, which is attached in a turn-drivable fashion to the slewing mechanism and which engages in a toothed rack running at a right angle to the vehicle frame. A horizontal slewing drive of this type permits a considerable diversion of the luffing jib from its normal position towards both sides of the crane.

The lifting drive located on the slewing mechanism can be designed in various ways. In an advantageous design, the lifting drive consists of two vertical and parallel lifting cylinders mounted on the slewing mechanism, which are held by means of a parallel connection. In this way, a rigid system for the guidance and swinging up of the luffing jib is first established, and then the possibility of additional functions is created. One of these additional functions consists of holding the two lifting cylinders around a horizontal, aligned axis on the slewing mechanism. The two lifting cylinders can simply follow the slewing movements of the luffing jib.

According to another feature of the invention, a guidance frame for the luffing jib is connected to the piston rods of the lifting cylinders. This creates a stress-capable connection between the luffing jib and the two lifting cylinders or with the slewing mechanism.

Furthermore, an improvement of the invention includes pairs of spreading arms, assigned to the lifting drive on both sides, which arms can be swung out in opposite directions and to which downwardly extending supporting rings are attached. Eccentricities of the center of gravity resulting from the swinging out of the luffing jib are thus caught.

Furthermore, a further embodiment of the invention consists of ballast tanks for ballast liquids arranged in the area of a driver's cabin on the vehicle frame. Such a system is highly flexible in taking into account the particular center of gravity. In further development of this basic idea, the ballast fluids from one ballast tank at one end of the vehicle frame can be decanted into another ballast tank on the other end of the vehicle frame. In this way, the particular center of gravity can be taken into account.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1A:
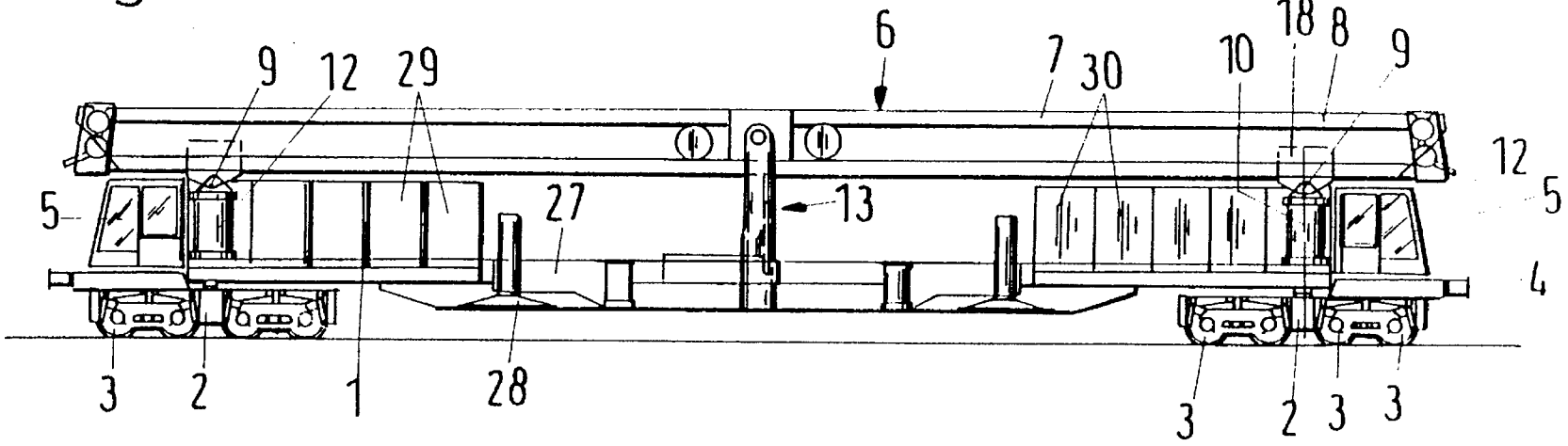
FIG. 1A is a side view of a railway crane.
Figure 1B:
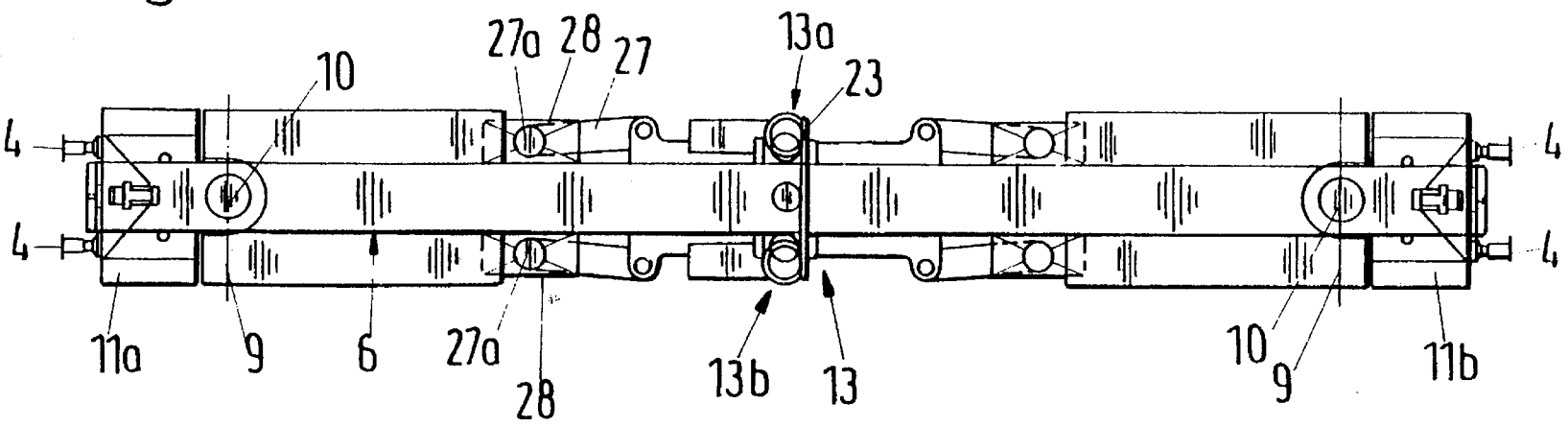
FIG. 1B is a top view of the railway crane in FIG. 1A.
Figure 2:
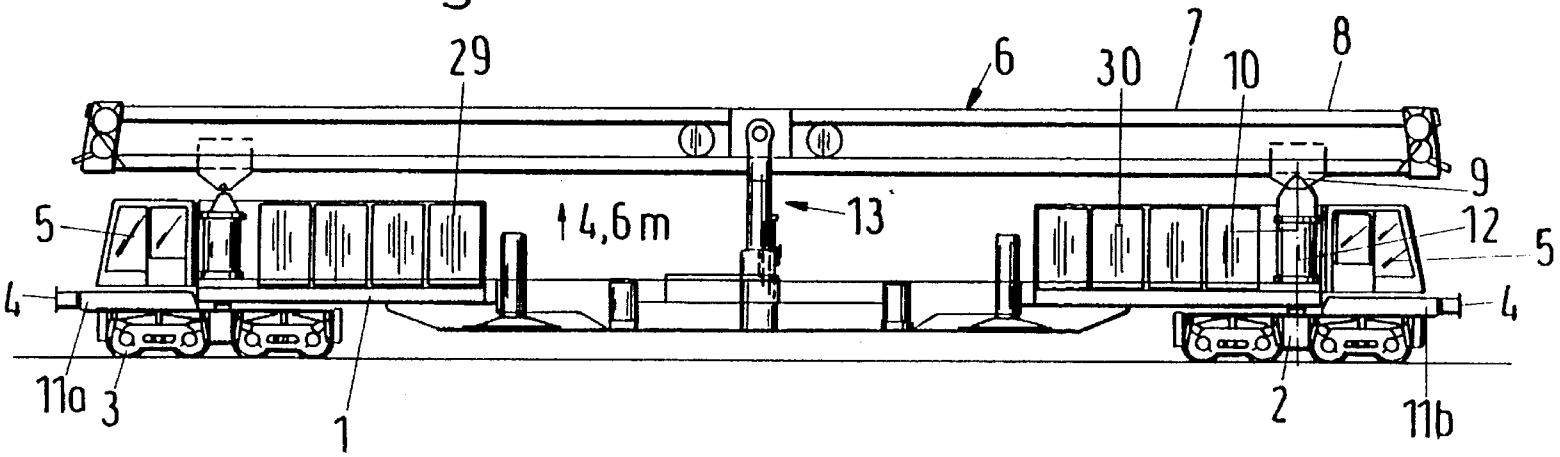
FIG. 2 shows the railway crane of FIG. 1A with a raised luffing jib.
Figure 3:
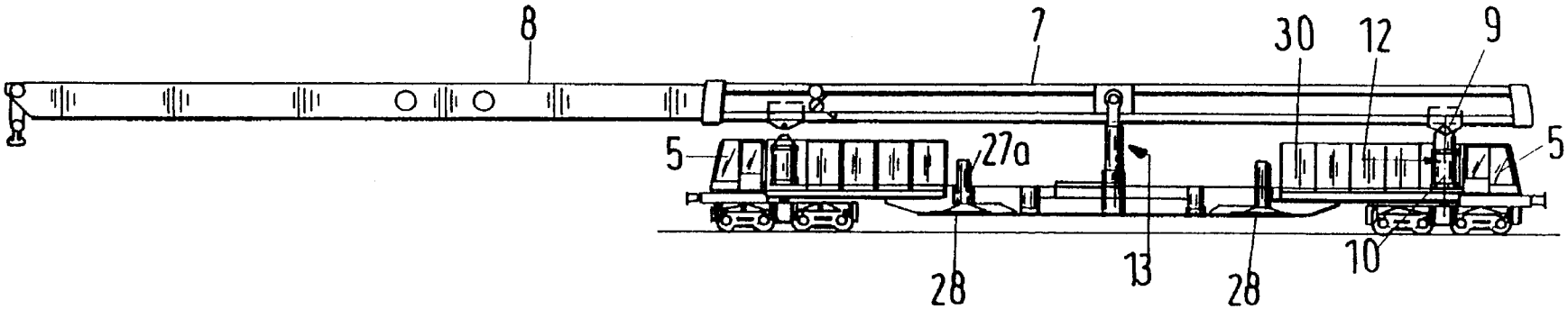
FIG. 3 shows the railway crane of FIG. 2 with the luffing jib raised and telescoped to the left.
Figure 4:
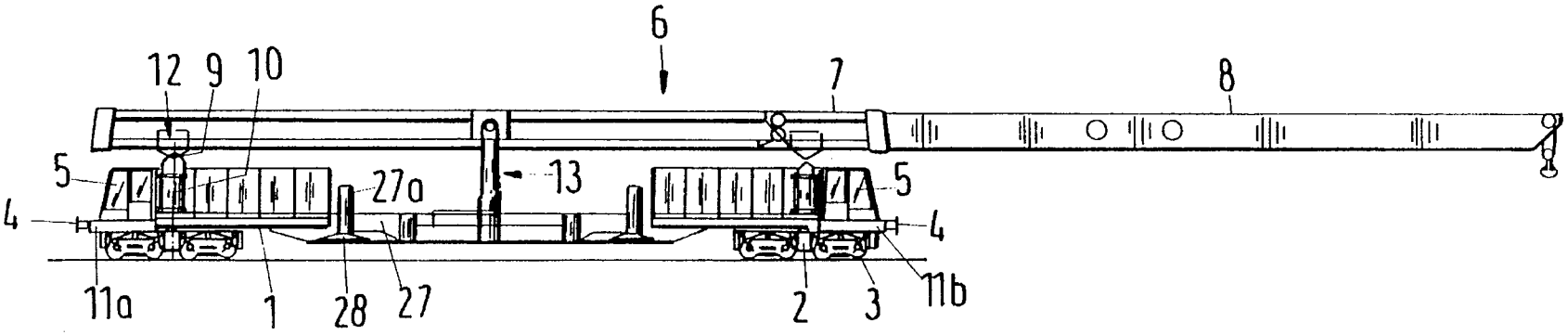
FIG. 4 shows the railway crane of FIG. 3 with the luffing jib telescoped to the right.

The crane can be used in stationary fashion or as a mobile crane, particularly as a railway crane. The railway crane shown has a vehicle frame 1, which rests on pivoted bogies 2 with, for example, four sets of wheels 3 each on the rails. On the vehicle frame 1 there are pairs of buffers 4 and one driver's cabin 5 on each end. In addition, there is a luffing jib 6, consisting of a basic jib 7 with telescopic piece 8, that is luffable upward and downward around a horizontal axis 9 and both rotatable and liftable around a vertical axis 10. In transport status, the luffing jib 6 is firmly connected to the two horizontal axes 9 (FIG. 1A). The jib 6 rests either on both of the swivel bearings 12 arranged respectively on the ends 11*a* or 11*b*, or on only one of the swivel bearings 12 and then on a lifting drive 13 located as centrally as possible. This lifting drive 13 thus forms a luffing cylinder that consists of two symmetrically arranged lifting cylinders 13*a* and 13*b* with their respective piston rods 13*c*.

Figure 11:
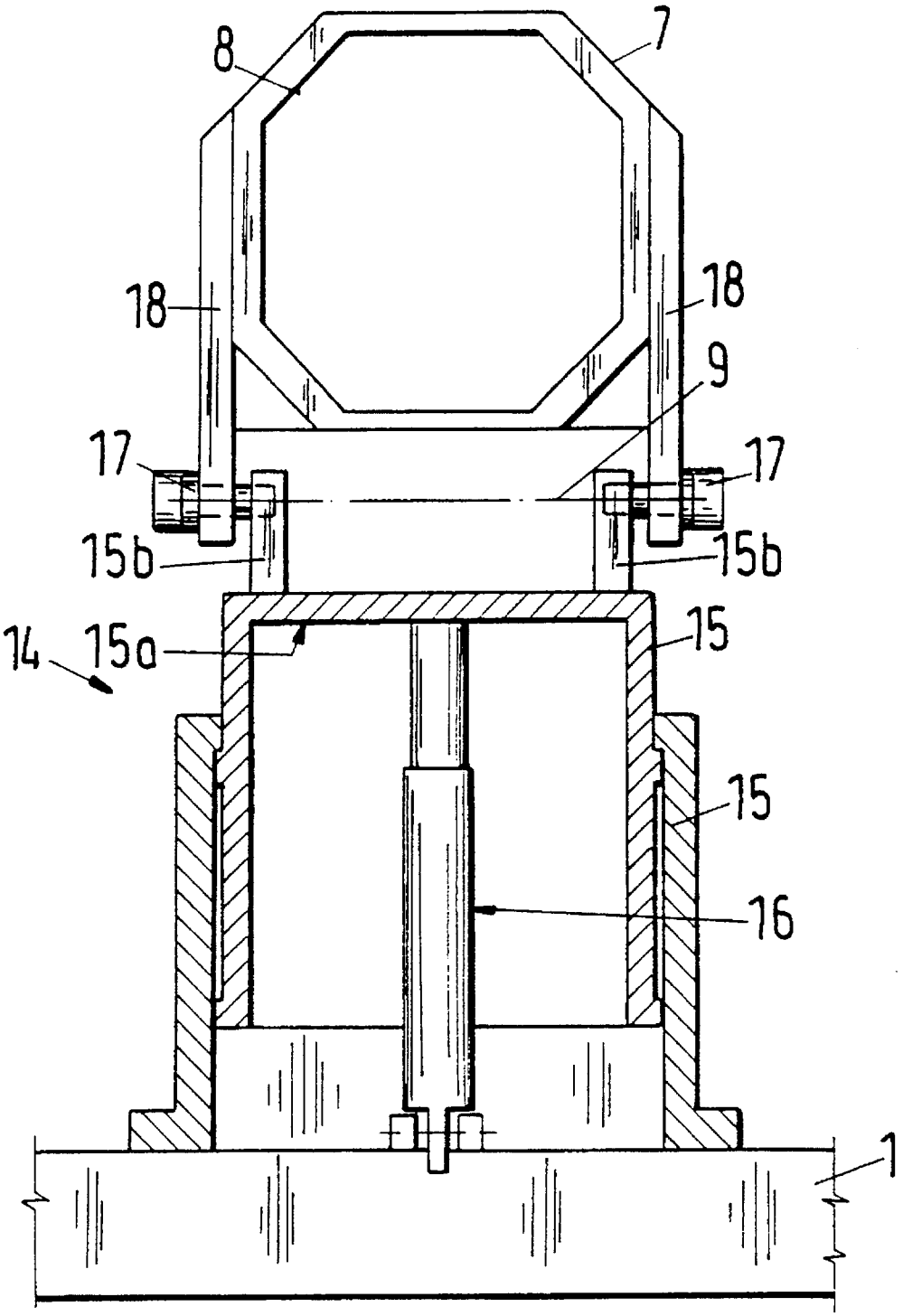
FIG. 11 is a cross-section through one of the two swivel bearings.

Each of the swivel bearings 12 can be individually connected in a detachable fashion to the luffing jib 6, so that the crane can operate towards both sides of the longitudinal extension of vehicle frame 1. Each of the swivel bearings 12 consists of a piston-cylinder unit 14, which is respectively formed of telescopic tube sections 15 and arranged on one end 11*a*, 11*b* of the vehicle frame. The swivel bearings 12 are themselves rotatable around the vertical axis 10 on the vehicle frame 1. Additionally, a lifting piston 16 engages (FIG. 11 ) under a cover 15*a* of the inner tube section 15. The tube sections 15 are twistable within one another, without a seal being necessary. An easy sliding movement can also occur between the cover 15*a* and the lifting piston 16. At the swivel bearing 12, there are laterally withdrawable hinge bolts 17 in side frame parts 18, which are attached to the basic jib 7. After detachment of the hinge bolts 17, which is done manually, a connection to the lugs 15*b* of the cover 15*a* is established.

Figure 7:
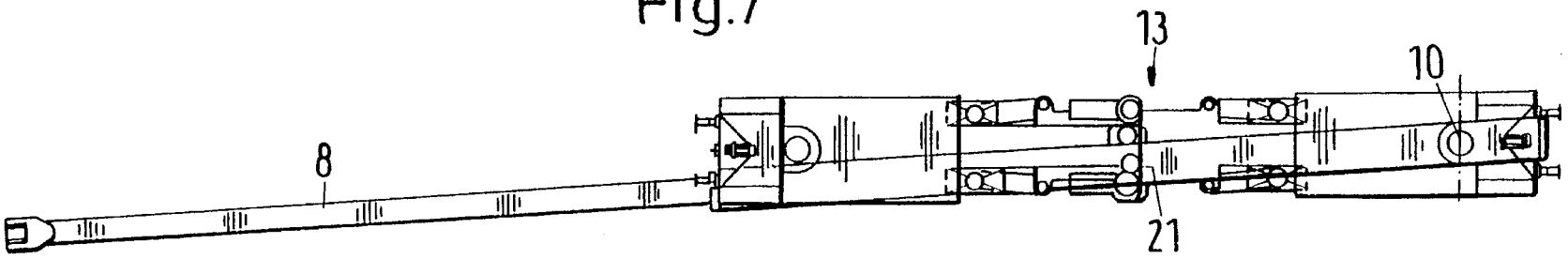
FIG. 7 is a top view of FIG. 6 with the luffing jib rotated toward the side.
Figure 8:
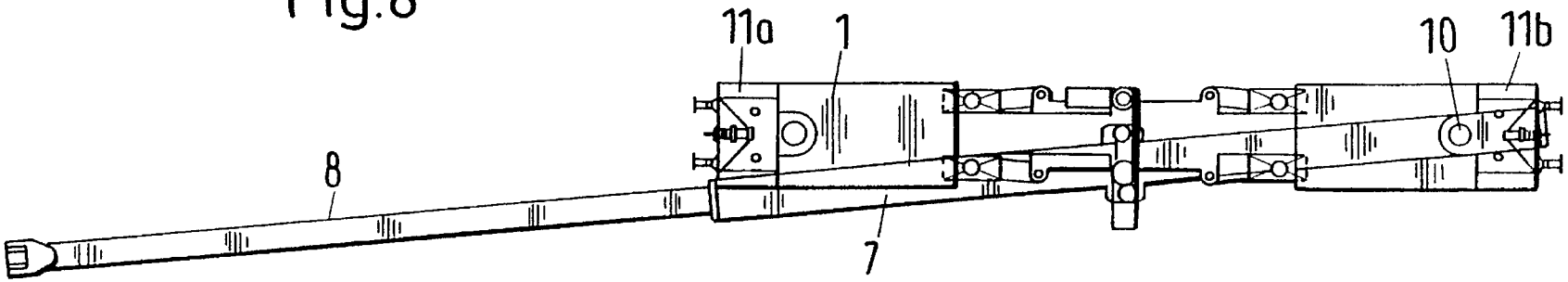
FIG. 8 is a top view as in FIG. 7; however, with greater rotation of the luffing jib to the side.
Figure 9:
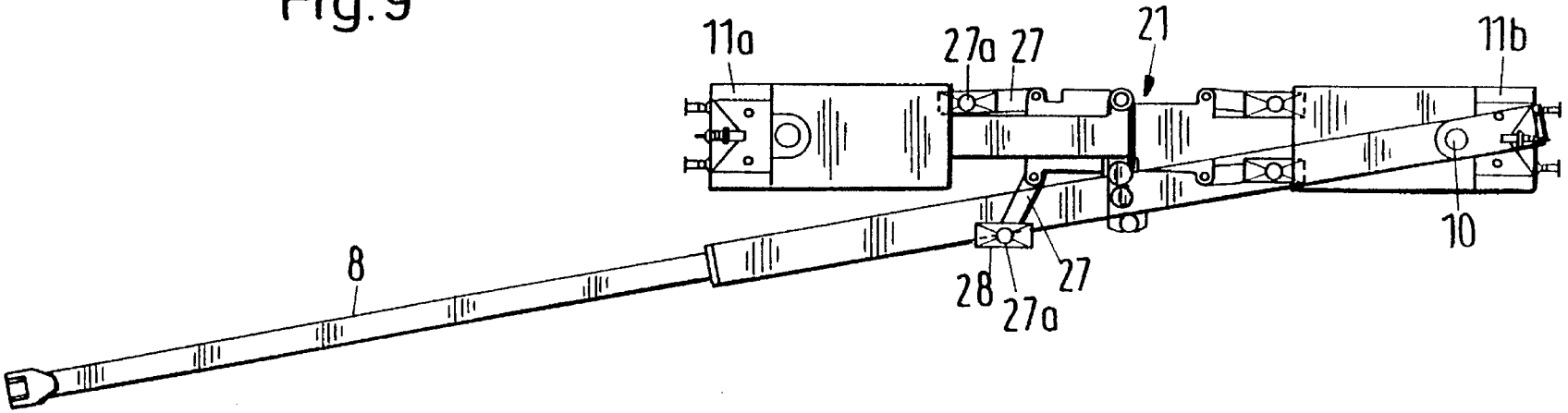
FIG. 9 is a top view as in FIG. 8 with swung-out spreading arms and supporting rings.
Figure 10:
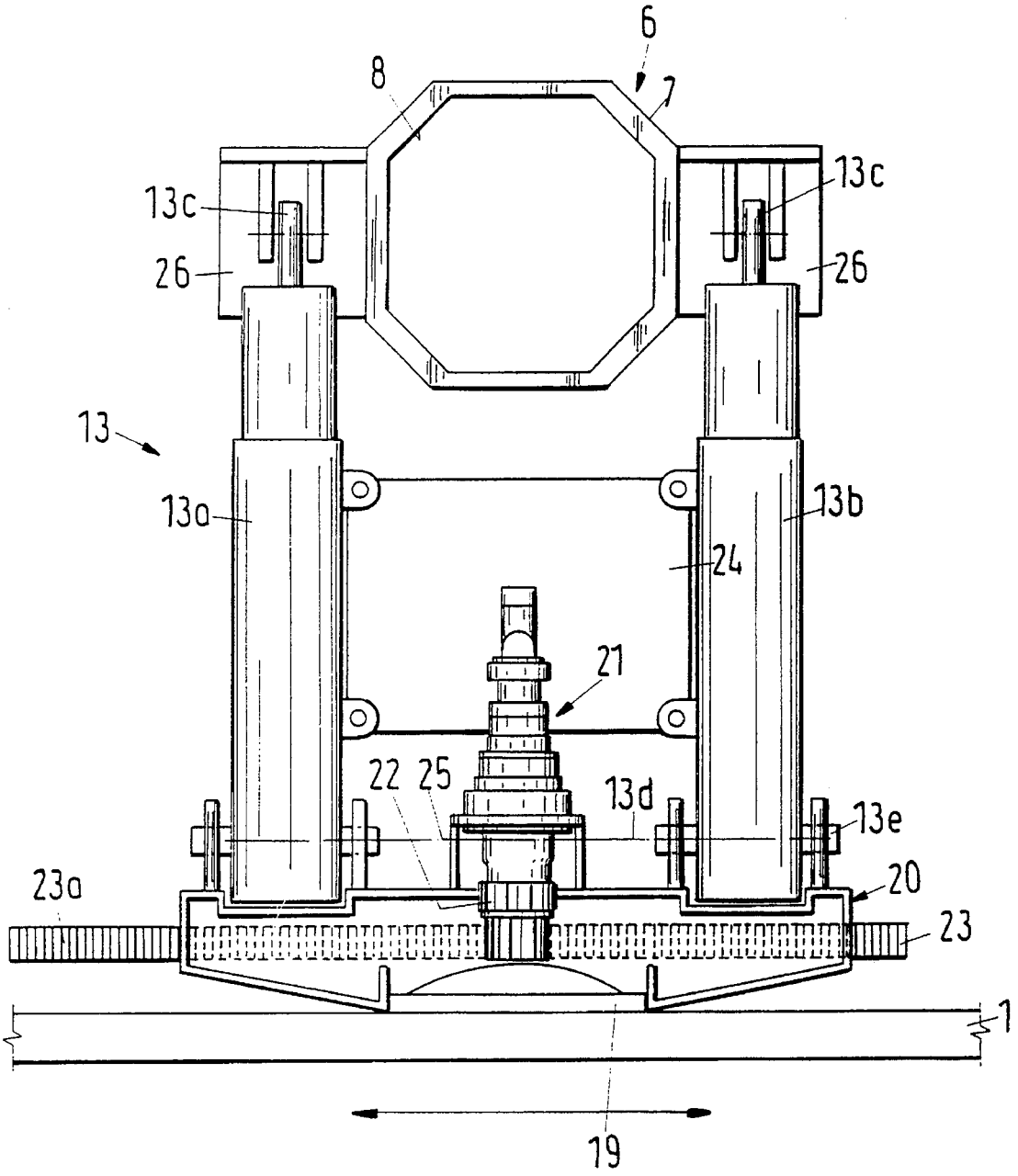
FIG. 10 is a cross-section through the lifting drive with slewing mechanism.

The lifting drive 13 is supported via a guide plate 19, which is attached to the vehicle frame 1, and is thus part of a slewing mechanism 20 (FIG. 10). A horizontal slewing drive 21 is located on the slewing mechanism 20, so that the lifting drive 13 can be turned with the luffing jib 6 (FIGS. 7 to 9). This horizontal slewing drive 21 consists of a pinion 22, which is located in a turn-drivable fashion on the slewing mechanism 20 and engages into a toothed rack 23 running at a right angle to the vehicle frame 1. The toothed rack 23 has collapsible sections 23*a*, so that the length of the toothed rack 23 can be expanded in one or both crossdirections. In FIG. 10, for example, the left section 23*a* is folded out.

Furthermore, the lifting drive 12 has the two aforementioned lifting cylinders 13*a*, 13*b*, arranged vertically and parallel to one another. The cylinders 13*a*, 13*b* are also slewable on the slewing mechanism 20 around horizontal tilting axes 13*d* by means of tilting bolts 13*e*. The pair of lifting cylinders 13*a*, 13*b* are hereby connected to one another by means of a parallel connection 24, which is formed as a plate or a frame. The two tilting axes 13*d* form an aligning axis 25. Furthermore, a guidance frame 26 for the luffing jib 6, i.e., for its basic jib 7, is connected on the piston rods 13*c* of the lifting cylinders 13*a*, 13*b*.

As shown in FIGS. 1A, 1B, and 6 to 9, pairs of spreading arms 27 which can be swung out in opposite directions are assigned to the lifting drive on both sides. On the downwardly extending struts 27*a* of the spreading arms 27 there are supporting rings 28, which catch a transfer in weight resulting from the turning of the luffing jib 6 (FIGS. 8 and 9).

In addition, such a transfer or a similar transfer of the overall center of gravity is compensated for by ballast tanks 29, 30, which can be filled with ballast fluid, e.g., water, and which are located in the area of the driver's cabin 5 on the vehicle frame 1. Depending on the elevation of the luffing jib 6, the ballast fluid is thus pumped into one or the other of the ballast tanks 29, 30 or filled proportionately during transport.

Figure 5:
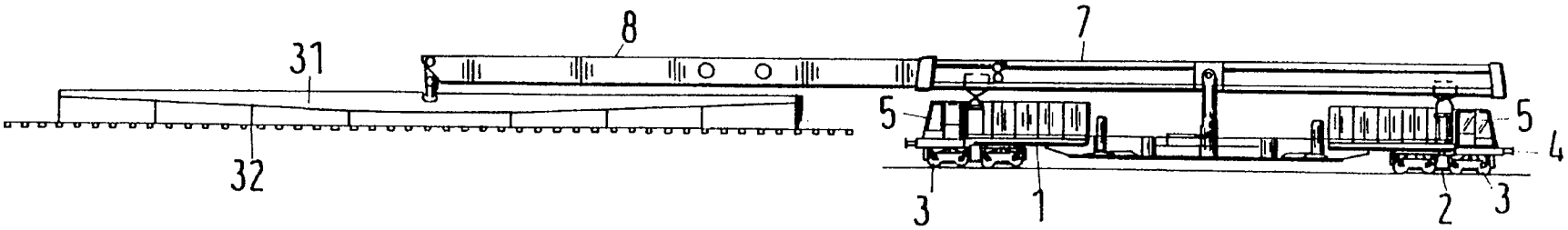
FIG. 5 shows the railway crane of FIG. 4 with a track section suspended on a cross piece.
Figure 6:
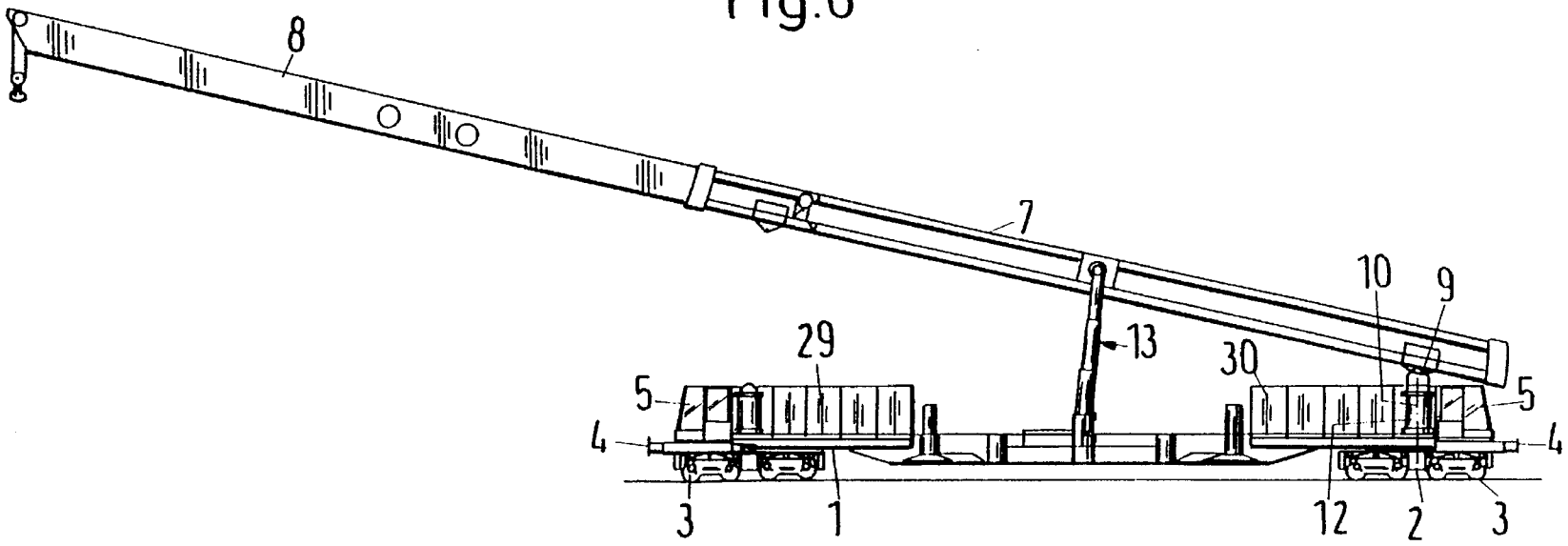
FIG. 6 is a side view of the railway crane with luffing jib slewed upward.

FIG. 5 shows the telescopic part 8 extended from the basic jib 7 and holding a cross piece 31 on which a rail section 32 is suspended.

The invention is not limited by the embodiments described above which are presented as examples only but can be modified in various ways within the scope of protection defined by the appended patent claims.

We claim:

1. A crane, comprising: a vehicle frame having ends; at least one swivel bearing located on each end of the vehicle frame; a luffing jib mounted on the swivel bearing at one of the ends of the vehicle frame so as to be luffable upward and downward around a horizontal axis and rotatable around a vertical axis; and lifting drive means arranged between the vehicle frame ends for lifting the luffing jib, the at least one swivel bearing at each end of the frame being adapted and configured to be selectively detachable from and connectable to the luffing jib so that the luffing jib can selectively operate at either end of the vehicle frame, the at least one swivel bearing at each end of the vehicle frame including a piston-cylinder unit connectable in a hinged manner to the luffing jib.

2. A crane as defined in claim 1, wherein the at least one swivel bearing at each end of the vehicle frame is arranged on the vehicle frame to be rotatable around a vertical axis.

3. A crane as defined in claim 1, wherein the piston-cylinder unit includes inner and outer telescopic tube sections, the inner tube section having a cover, the piston-cylinder unit further including a lifting piston arranged so as to engage under the cover of the inner tube section.

4. A crane as defined in claim 1, wherein the at least one swivel bearing at each end of the vehicle frame includes a side frame part and detachable hinge bolts that connect the side frame part to the luffing jib so that the side frame part is slewable relative to the piston-cylinder unit around the detachable hinge bolts.

5. A crane as defined in claim 1, and further comprising a guide plate mounted on the vehicle frame, and a slewing mechanism arranged at the guide plate, the lifting drive means being supported on the slewing mechanism via the guide plate of the vehicle frame.

6. A crane as defined in claim 1, and further comprising horizontal slewing drive means for driving the luffing jib connected to the lifting drive means.

7. A crane as defined in claim 6, wherein the horizontal slewing drive means includes a toothed rack arranged to run at a right angle to the vehicle frame, a slewing mechanism, and a pinion located on the slewing mechanism in a rotationally-driveable manner and so as to engage in the toothed rack whereby the lifting drive means can be moved along the toothed rack with slewing of the luffing jib.

8. A crane as defined in claim 7, wherein the lifting drive means includes two lifting cylinders attached to the slewing mechanism so as to be vertical and parallel, and a parallel connection for holding the lifting cylinders together.

9. A crane as defined in claim 8, wherein the two lifting cylinders are mounted on the slewing mechanism so as to be tiltable around a horizontal, aligned axis.

10. A crane as defined in claim 8, wherein the lifting cylinders have piston rods, and further comprising a guidance frame for the luffing jib connected to the piston rods of the lifting cylinders.

11. A crane as defined in claim 1, and further comprising pairs of spreading arms arranged on the vehicle frame at both sides of the lifting drive means so as to be outwardly pivotable in opposite directions, and downwardly extending supporting rings attached to the spreading arms.

12. A crane as defined in claim 1, and further comprising a driver's cabin mounted on each end of the vehicle frame, and ballast tanks for ballast fluids arranged on the vehicle frame in an area of the driver's cabins.

13. A crane as defined in claim 12, wherein the ballast tanks are arranged and configured so that ballast fluids can be decanted from one ballast tank on one end of the vehicle frame into another ballast tank on the other end of the vehicle frame.

14. A crane, comprising:

a vehicle frame having ends;

at least one swivel bearing located on each end of the vehicle frame;

a luffing jib mounted on the swivel bearing at one of the ends of the vehicle frames so as to be luffable upward and downward around a horizontal axis and rotatable around a vertical axis;

lifting drive means arranged between the vehicle frame ends for lifting the luffing jib, the at least one swivel bearing at each end of the frame being adapted and configured to be selectively detachable from and connectable to the luffing jib so that the luffing jib can selectively operate at either end of the vehicle frame;

a driver's cabin mounted on each end of the vehicle frame; and ballast tanks for ballast fluids arranged on the vehicle frame in an area of the driver's cabins, the ballast tanks being arranged and configured so that ballast fluids can be decanted from one ballast tank on one end of the vehicle frame into another ballast tank on the other end of the vehicle frame.

* * * * *